US005129520A

United States Patent [19]

Gaspar

[11] Patent Number: 5,129,520

[45] Date of Patent: Jul. 14, 1992

[54] PHARMACEUTICAL CONTAINER

[75] Inventor: Ruben C. Gaspar, St. Davids, Pa.

[73] Assignee: Merck & Co., Inc., Rahway, N.J.

[21] Appl. No.: 730,338

[22] Filed: Jul. 15, 1991

[51] Int. Cl.[5] ..... B65D 1/04; B65D 83/04

[52] U.S. Cl. ..... 206/534; 206/232; 215/6

[58] Field of Search ..... 215/6; 206/232, 534

[56] References Cited

U.S. PATENT DOCUMENTS

| | | | |
|---|---|---|---|
| 197,542 | 11/1877 | Carman | 215/6 |
| 378,752 | 2/1888 | Ader | 215/6 |
| 3,256,978 | 6/1966 | Srigley et al. | 206/232 |
| 3,433,378 | 3/1969 | Ross | 215/6 |
| 4,805,789 | 2/1989 | Lancesseur et al. | 215/6 |

FOREIGN PATENT DOCUMENTS

| | | | |
|---|---|---|---|
| 115851 | 12/1900 | Fed. Rep. of Germany | 215/6 |
| 740184 | 11/1932 | France | 215/6 |

*Primary Examiner*—William I. Price
*Attorney, Agent, or Firm*—Donald J. Perrella; Joseph F. Diprima

[57] ABSTRACT

A plastic pharmaceutical container is provided with a removable bottom section defining a cavity adapted to hold the package circular.

11 Claims, 1 Drawing Sheet

PHARMACEUTICAL CONTAINER

BACKGROUND OF THE INVENTION

Printed paperboard cartons are often used to package pharmaceutical containers. Once opened the cartons have to be disposed of, thereby placing a burden on the environment. The containers often provide the package circular (professional or patient literature) in a folded strip that is glued to the cap or side of the bottle. When the package circular is detached for reading, there is no way to reattach it to the container.

OBJECTS OF THE INVENTION

It is, accordingly an object of the present invention to provide a pharmaceutical container having hidden means to store the package circular. Another object is to provide a pharmaceutical container adapted to permit removal and reattachment of the package circular. Still another object is to provide a pharmaceutical container having a more attractive appearance. A further object is to provide a pharmaceutical container that does not require shipment in a paperboard carton. These and other objects of the present invention will be apparent from the following description.

SUMMARY OF THE INVENTION

A plastic pharmaceutical container is provided with a bottom section defining a cavity in which a package circular may be stored out of sight and removed and reattached as often as desired. The bottom ring is adapted to snap onto the bottom of the pharmaceutical container and the bottom of the ring is provided with means adapted to receive and hold a package circular, and to permit its removal and reattachment.

It should be understood that the drawings are not necessarily to scale and that the embodiments are sometimes illustated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION

The dispenser device of the present invention preferably is made of a flexible plastic material, for example, low density polyethylene, and can be prepared by any suitable technique, for example, blow molding. It is to be understood that the present invention is not limited to the specific material from which the dispenser device of the present invention is made, or the particular process by which it is made as it will be understood by those skilled in the art that many different materials and various manufacturing techniques may be employed.

The pharmaceutical container of the present invention will now be described with reference to the drawings. The container 10 is preferably formed of a flexible material such as, for example, polyethylene, and is provided with a closure such as, for example, a screw cap. The bottom 12 is recessed relative to the sidewall 13 and contains an annular groove 14.

Figure 1:
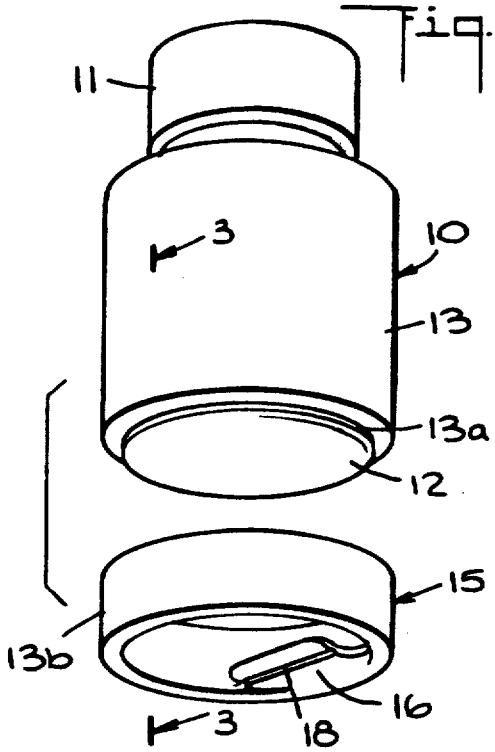
FIG. 1 is a perspective view of one embodiment of a container of the present invention and its bottom section.
Figure 2:
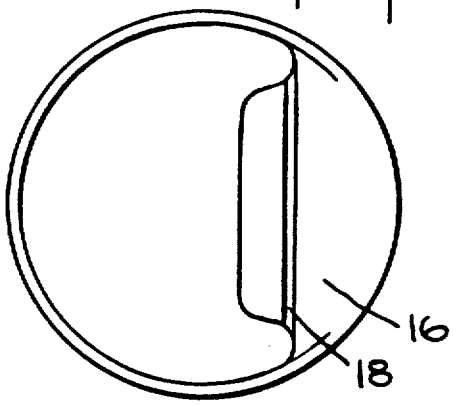
FIG. 2 is a bottom view of the section.
Figure 3:
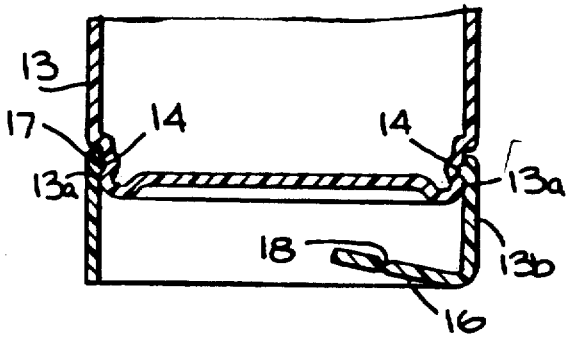
FIG. 3 is a cross-sectional view of the bottom section attached to the container.
Figure 4:
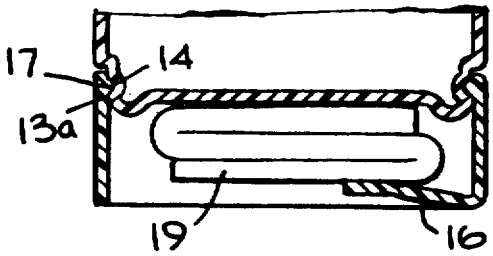
FIG. 4 is a cross-sectional view of a package circular being stored in the bottom section.
Figure 5:
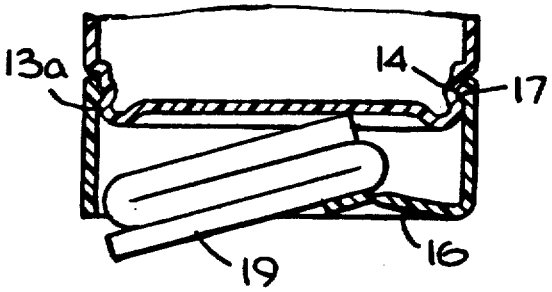
FIG. 5 is a plan view of the package circular being inserted (or removed from) the bottom section.
Figure 6:
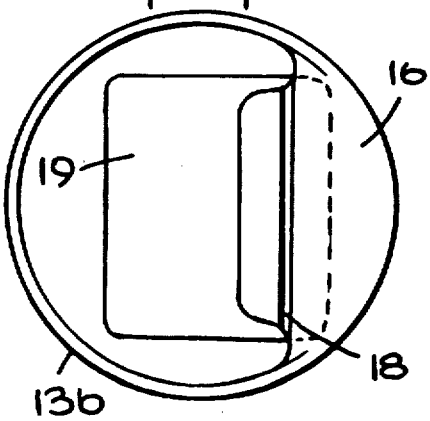
FIG. 6 is a bottom view of the bottom section after insertion of the package circular.

Bottom section 15 is designed to fit over the recessed bottom 12 of container 10. Preferably, the thickness of section 15 is predetermined so that the sidewall 13 of container 10 and sidewall 16 of section 15 form a flush surface. The interior surface 16 of sidewall 15 is provided with annular flange 17 adapted to be received into groove 14. Alternatively, the annular flange 17 can be located on the sidewall of the bottom 12 and groove 14 can be located on sidewall 16 (not shown as obvious). A flange 16 extends partly across the bottom of section 15. Flange 16 may be perpendicular to the sidewall 13*a* or may even be disposed at an angle greater than perpendicular, in which case it points down, but preferably is disposed at an angle less than perpendicular so that it points up. Flange 16 contains a source 18 near its terminus thereby forming a living hinge to facilitate insertation and removal of the package circular. A folded package circular 19 can be fitted into (and removed from) the empty space above flange 16 as shown in FIG. 5 and is stored as shown in FIGS. 4 and 6.

While the present invention has been described with reference to a pharmaceutical container, it is to be understood that the present invention is equally applicable to containers for other materials, for example, cosmetic and foodstuff containers.

What is claimed is:

1. A section adapted to attach to the bottom of a container, the section comprising a wall enclosing a space, the wall substantially identical in configuration to that of the bottle to which it is adapted to be fitted, and a flange extending from about the bottom of the section at an angle not greater than perpendicular to the wall of the section.

2. A section according to claim 1 wherein the inner surface of the wall is straight.

3. A section according to claim 1 wherein the inner surface of the wall contains a perimeter flange.

4. A section according to claim 1 wherein the bottom flange extends at an angle other than perpendicular to the wall of the section.

5. A section according to claim 1 wherein the bottom flange extends at an angle less than perpendicular to the wall of the section.

6. A section according to claim 1 wherein the terminus of the bottom flange is hinged.

7. A section according to claim 6 wherein the hinge is a living hinge.

8. A section according to claim 4 wherein the bottom flange is hinged.

9. A section according to claim 8 wherein the hinge is a living hinge.

10. A section according to claim 5 wherein the bottom flange is hinged.

11. A section according to claim 10 wherein the hinge is a living hinge.

* * * * *